United States Patent [19]

Miska

[11] Patent Number: 4,805,300

[45] Date of Patent: Feb. 21, 1989

[54] ELECTRIC DRY SHAVER HAVING AN IMPROVED DRIVE ARRANGEMENT

[75] Inventor: Aivars Miska, Stratford, Conn.

[73] Assignee: Remington Products, Inc., Bridgeport, Conn.

[21] Appl. No.: 908,329

[22] Filed: Sep. 17, 1986

[51] Int. Cl.[4] ..... B26B 19/10

[52] U.S. Cl. ..... 30/34.1; 30/43.92

[58] Field of Search ..... 30/34.1, 43.92, 43.91, 30/32, 43

[56] References Cited

U.S. PATENT DOCUMENTS

| | | | |
|---|---|---|---|
| 3,714,711 | 2/1973 | Daniels | 30/43.92 |
| 4,030,573 | 6/1977 | Buzzi et al. | 30/43.92 X |
| 4,089,109 | 5/1978 | Czerner et al. | 30/34.1 |
| 4,167,060 | 9/1979 | Sakamoto | 30/43.92 |
| 4,505,036 | 3/1985 | Ochiai et al. | 30/34.1 |

*Primary Examiner*—Frank T. Yost
*Assistant Examiner*—Michael D. Folkerts

[57] ABSTRACT

An improved foil type of electric dry shaver is described wherein an inner assembly of cutter blades for a short hair cutter and a cutter member for a long hair trimmer are simultaneously actuated for reciprocating motion in opposite directions by first and second drive bodies which are mounted to first and second housing segments for the shaver.

6 Claims, 3 Drawing Sheets

ELECTRIC DRY SHAVER HAVING AN IMPROVED DRIVE ARRANGEMENT

BACKGROUND OF THE INVENTION

1. Field of the Invention

This invention relates to electric dry shavers. The invention relates more particularly to an improved arrangement for mechanically intercoupling an electric drive motor with a short hair cutter and a hair trimmer of the shaver.

2. Description of the Prior Art

Electric dry shavers are known which include a shaver head having a short hair cutter for shaving relatively short facial hairs and a hair trimmer for shearing relatively longer hairs. One known type is a foil shaver wherein the short facial hair cutter comprises a stationary, apertured, outer foil cutter member and an inner assembly of cutter blades. The inner assembly reciprocates relative to the stationary foil and, in cooperation therewith, shears short facial hairs which extend through the foil apertures. The hair trimmer includes a stationary comb member and a moveable cutter member, each having a plurality of teeth. Reciprocating motion is established between these comb and cutter members and relatively longer body hairs which extend between the reciprocating teeth are sheared. In one arrangement, the short hair cutter and the hair trimmer are simultaneously actuated by mechanical coupling to the same electric motor. An electric dry shaver of this type is disclosed in U.S. Pat. No. 4,089,109.

A particular arrangement of a foil shaver includes a rotating armature motor having a rotary output shaft. Mechanical coupling between the motor and the short hair cutter and the hair trimmer includes a drive body which cooperates with a cam means to transform rotary shaft motion of the motor to reciprocating motion of the blade assembly and the trimmer cutter. Efficiency of operation makes it desirable to minimize power losses which are introduced by the mechanical coupling and motion conversion. One form of drive body comprises a relatively light weight polymer plastic body having an integral U-shaped segment and a pair of depending, relatively thin, wall segments which suspend and support the U-shaped segment. The U-shaped segment is supported near a lower part of legs of the segment for relatively friction free suspension and reciprocating motion upon actuation by the motor. A segment for engaging the short hair cutter blade assembly and imparting reciprocating motion thereto is also integrally formed with the U-shaped body. A similar drive body has also been provided for the trimmer cutter. In one arrangement, the mechanical coupling between the rotary shaft motor and the trimmer provides for simultaneous actuation of the short hair cutter and the hair trimmer in opposite, reciprocating directions in order to provide relatively balanced, mechanical operation of the shaver.

In view of the suspension of the U-shaped segment by the relatively thin wall segments, the positioning, mounting and assembly of the drive body has been relatively complex and costly. In one arrangement as illustrated in U.S. Pat. No. 3,714,711, a metal clip is provided and is mounted to the electric motor. The polymer plastic drive body is secured to the metal clip with captivating clips and this assembly is mounted to an upper housing member of the shaver. While this arrangement is advantageous, the resulting construction requires a number of parts thus increasing the relative costs and assembly costs. In addition, the number of metal parts creates an operating noise level which is greater than desirable.

SUMMARY OF THE INVENTION

Accordingly, is an object of this invention to provide an improved arrangement for mounting a coupling drive body of the type described in an electric dry shaver.

Another object of the invention is to provide an improved arrangement for mounting first and second coupling drive bodies which simultaneously actuate a short hair cutter and a trimmer, respectively from a single drive motor.

Another object of the invention is to provide an improved mechanical coupling arrangement for a foil type electric dry shaver.

Another object of the invention is to provide an improved electric dry shaver.

In accordance with features of the invention, an electric dry shaver includes an elongated, hand-held housing which is formed by first and second members which engage along the length of the housing. A shaver head which is positioned at one end of the housing includes a short hair, inner cutter assembly of cutter blades and a hair trimmer having a reciprocating cutter. A coupling means for simultaneously coupling an electric motor positioned within the housing to the inner cutter assembly and to the hair trimmer cutter includes first and second drive bodies, each having a generally U-shaped configuration. Each of the bodies includes relatively thin wall segments for supporting the U-shaped body and a support means which is integrally formed with each of the thin wall segments for engaging the housing. The first body includes means for engaging the first housing segment for supporting the first body from the first housing segment and the second body includes means for engaging the second housing segment for supporting the second body from the second housing segment. In a particular embodiment, assembly of the support bodies as a unit to the housing segments is facilitated by providing means which mutually engage the support bodies.

BRIEF DESCRIPTION OF THE DRAWINGS

These and other objects and features of the invention will become apparent from the following specification and the drawings wherein.

DETAIL DESCRIPTION

Figure 1:
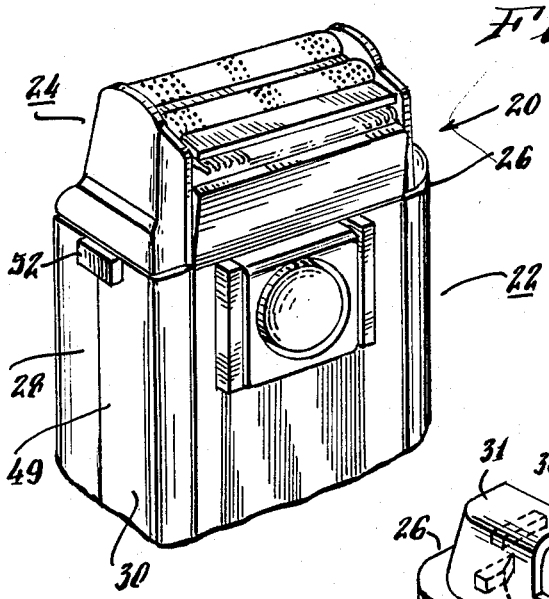
FIG. 1 is a fragmentary, perspective view of an electric dry shaver constructed in accordance with features of this invention.
Figure 2:
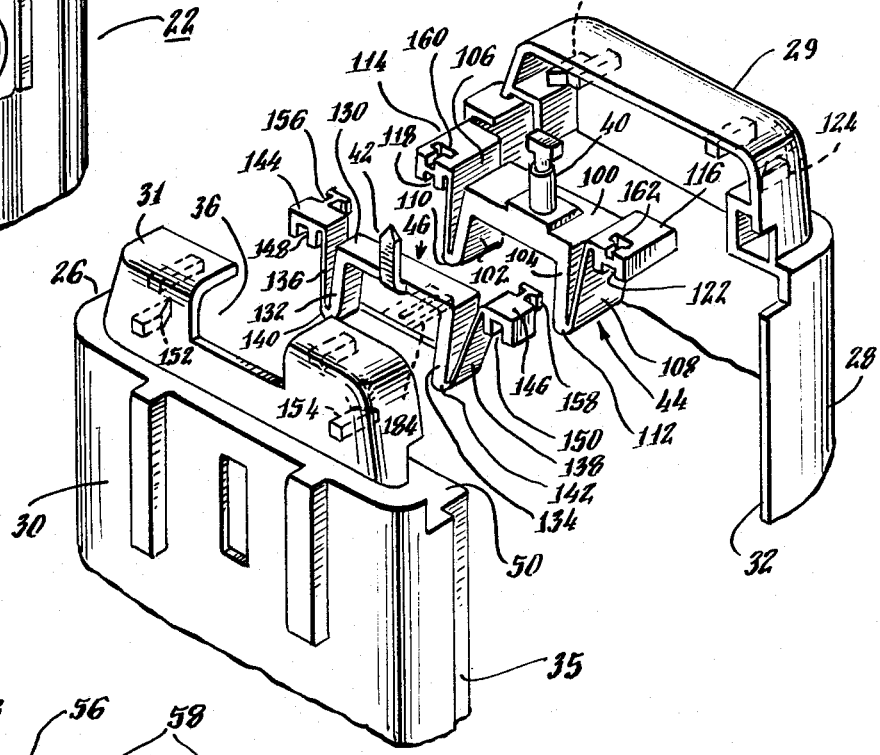
FIG. 2 is a fragmentary, exploded view of a portion of the shaver housing of FIG. 1 and coupling drive body for illustrating the mounting of the drive body to housing members.
Figure 3:
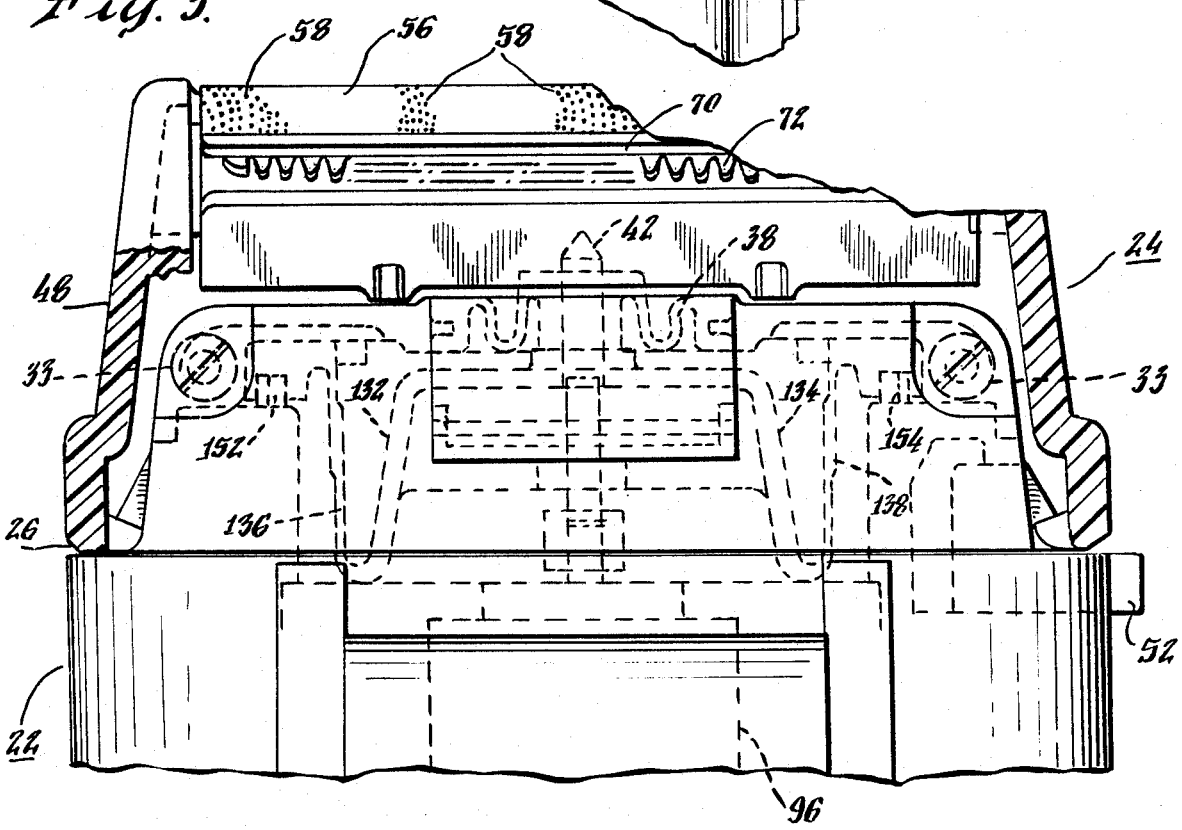
FIG. 3 is a fragmentary, enlarged front elevation view, partly cut away illutrating the electric drive shaver of FIG. 1.
Figure 4:
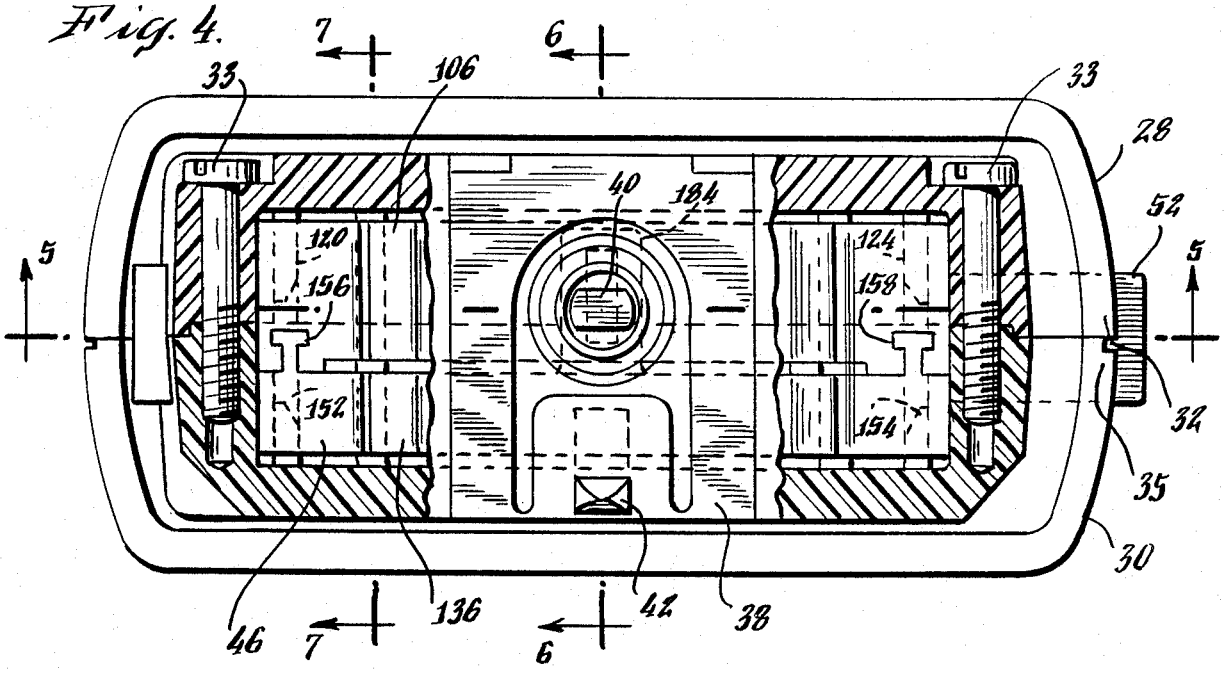
FIG. 4 is a plan view, partly cut away and partly in section of the electric dry shaver of FIG. 3.
Figure 5:
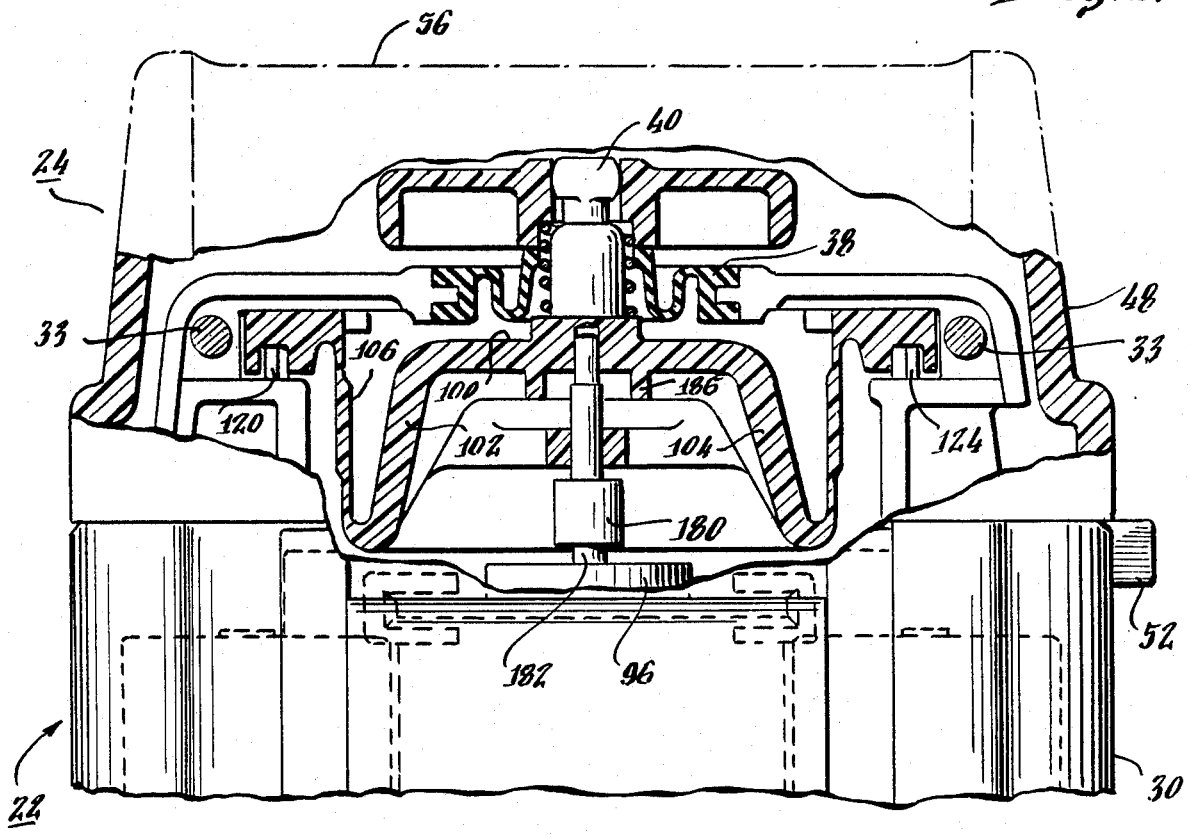
FIG. 5 is a view, partly broken away and partly in section, taken along Line 5—5 of FIG. 4.
Figure 6:
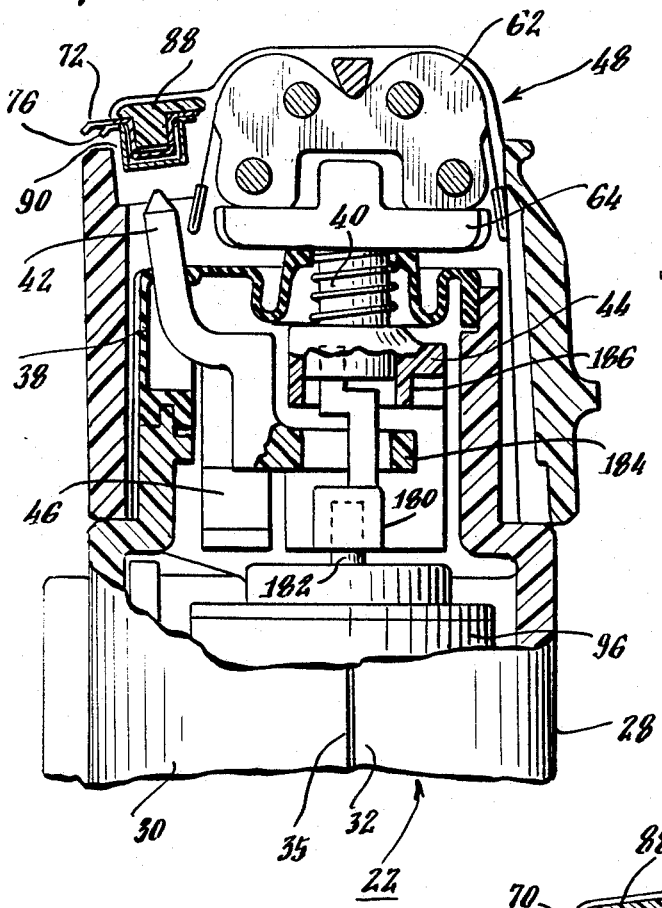
FIG. 6 is a view, partly broken away, taken along Line 6—6 of FIG. 4.

Referring now to the drawings, an electric dry shaver 20 is shown to include an elongated hand-held housing 22 and a cutter head 24 positioned at one end 26 of the housing 22. The housing comprises a first elongated housing member 28 having an integrally formed dome segment 29 and a second elongated housing member 30 also having an integrally formed dome segment 31. The housing members 28 and 30 engage along a longitudinal sides 32 and 35, respectively and are secured together by screw means 33 (FIG. 4) to provide a unitary hand-held housing as illustrated in FIG. 1. When so assembled, the housing segments 29 and 30 provide a dome segment having an aperture 36 (FIG. 2) formed therein. This aperture is sealed by a hair stopper 38 (FIG. 6). Drive engaging segments 40 and 42 of first and second drive bodies 44 and 46 respectively extend through the hair stopper 38. The drive bodies 44 and 46 are described in greater detail hereinafter. The hair stopper 38 is disclosed and claimed in co-pending U.S. patent application Ser. No. 908,325 filed concurrently herewith, entitled ELECTRIC DRY SHAVER HAVING AN IMPROVED SEALING MEANS and which is assigned to the assignee of this invention.

The cutter head 24 includes a hair pocket 48 which is positioned at the housing end 26 about the dome and is seated on a shoulder 50 of the housing. The hair pocket 48 is locked in this position by a latch, not shown, which can be released for dismounting from the shaver by depressing a push button 52 which is positioned on one side 49 of the housing. Mounted to the hair pocket 48 is a first cutter member of a short hair cutter which comprises a foil 56 having a plurality of apertures 58 formed therein. An assembly of cutter blades 62 is mounted on a blade support body 64 whch in turn is supported on the drive segment 40 and is actuated by the drive segment 40 to provide reciprocating motion with the apertured foil 56. Facial hairs which extend through the apertures are cut by the shearing action provided between the inner cutter blades and the foil.

Figure 8:
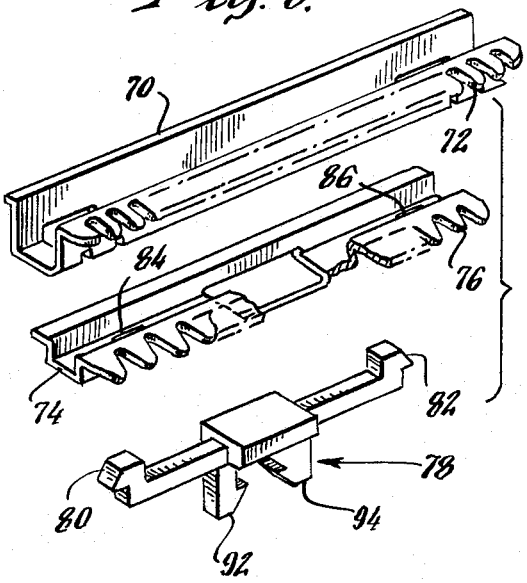
Figure 7:
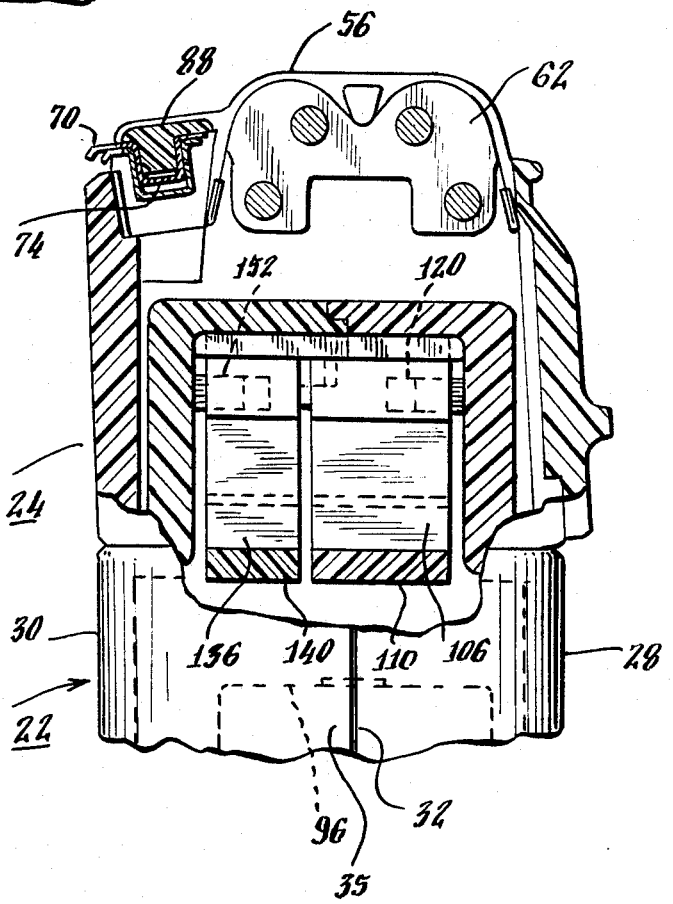
FIG. 7 is a view, partly broken away, taken along Line 7—7 of FIG. 4; and, FIG. 8 is an exploded view of members of the hair trimmer of FIG. 1.

The long hair trimmer comprises an elongated stationary comb member 70 having a generally U-shaped cross sectional configuration including a plurality of teeth 72, and a movable cutter member 74, also having a generally U-shaped cross sectional configuration including a plurality of teeth 76. An actuating member 78 is mounted to the moveable cutter member 74 by post segments 80 and 82 which extend through and engage apertures 84 and 86, respectively of the cutter member 74. The hair trimmer members are assembled by a hair trimmer cover member 88 (FIG. 6) in a recess 90 of the hair pocket 48 and are secured thereto. Actuating segment 42 of the drive body 46 extends through and engages a yolk comprising segments 92 and 94 of the actuating member 78 (FIG. 8). Reciprocating motion of the segment 42 of the drive body 46 causes the cutter member 74 to reciprocate and, in cooperation with the comb member 70, to shear relatively long hairs which extend between the teeth 72 and 76. The foregoing hair trimmer is disclosed in greater detail and is claimed incopending U.S. patent application Ser. No. 908,330 filed concurrently herewith entitled ELECTRIC DRY SHAVER HAVING AN IMPROVED TRIMMER ARRANGEMENT and which assigned to the assignee of this invention.

The drive bodies 44 and 46 simultaneously couple the short hair cutter blade assembly 62 and the trimmer cutter 74 to a rotary amarture electric motor 96 which is mounted within the housing 22. Each of the drive bodies 44 and 46 has a generally U-shaped configuration. Drive body 44 includes a platform segment 100 (FIG. 2) with first and second integrally formed legs 102 and 104, respectively extending therefrom. The drive body 44 further includes first and second relatively thin walled support and suspension segments 106 and 108 which engage the leg segments 102 and 104 at lower, distal locations 110 and 112 respectively. These relatively thinwall segments 106 and 108 are integrally formed with the body 44 and form a generally U-shaped configuration in combination with the depending leg segments 102 and 104. Positioned at an opposite end of the support and suspension segments 106 and 108 are support members 114 and 116, respectively which are integrally formed with the support suspension segments for mounting the body 44 to the housing segment 28. Member 114 includes a groove 118 integrally formed therein which is configured and positioned for engaging a rib 120 which is integrally formed in the housing sement 28. Similarly, the support member 116 also includes a groove 122 also configured and positioned for engaging a rib 124 which is integrally formed in the housing segment 28. In assembly, the body 44 is mounted to the housing segment 28 by sliding the support members 114 and 116 into engagement with the ribs 120 and 124.

The generally U-shaped drive body 46 similarly includes a platform segment 130 (FIG. 2) and first and second leg segments 132 and 134, respectively which depend therefrom. Relatively thin walled first and second support and suspension segments 136 and 138, respectively are integrally formed with the drive body 46 and engage distal segments 140 and 142 of the legs segmsnts 132 and 134 respectivley. Drive body support means comprise first and second members 144 and 146 which are integrally formed with the support and suspension segments 136 and 138, respectively. These support members include grooves 148 and 150, respectively which are configured and positioned for engaging ribs 152 and 154, respectively which are integrally formed in the housing segment 30.

The drive bodies 44 and 46 are mutually interlocked by means comprising tab segments 156 and 158 which are formed in the support members 144 and 146, respectively of the drive body 46. These tab segments are shaped to conform with and to engage recesses 160 and 162 formed in the support members 114 and 116 respectively of the drive body 44. In the embodiment illustrated, the tabs and recesses are T-shaped. By this means, the drive bodies 44 and 46 may be interlocked during assembly of the shaver for facilitating the mounting of the drive bodies as a unit to one of the housing segments 28, 30 and positioning the other housing segment to then engage the assembly of these bodies.

The reciprocating motion in opposite directions which is imparted to the inner assembly of blades 62 of the short hair cutter and to the hair trimmer cutter 74 is provided by a cam body 180 (FIG. 6) which is mounted to a rotary output shaft 182 of the electric motor 96 and which engages cam follower segment 184 of the drive body 46 and 186 of the drive body 44. The cam follower segments 184 and 186 are integrally formed with the drive bodies 46 and 44 respectively and, in a well known manner, are adapted and configured along with the cam body 180 to cause the associated drive segments 42 and 40 to simultaneously reciprocate in opposite directions.

The housing body segments 28 and 30 are formed of a suitable plastic and the mounting segments 120, 124 of segment 28 and 152, 154 of 30 are readily, integrally formed in these housing segments. The drive bodies 44 and 46 are also formed of a polymer plastic and the thin wall support and suspension segments, as is known, enable a relatively low loss reciprocating drive of these segments from the electric motor 96.

The arrangement thus described is advantageous in that the drive coupling for both a short hair cutter and the long hair trimmer are driven simultaneously from a same rotary motor in opposite reciprocating directions with an arrangement which is relatively simple and reliable, requires a relatively few number of parts, can be assembled at relatively low cost, and provides a reduced noise level in operation.

While there has been described a particular embodiment of the invention, it will be appreciated by those skilled in the art that variations may be made thereto without departing from the spirit of the invention and the scope of the appended claims.

What is claimed is:

1. An improved electric dry shaver comprising:

a. An elongated, hand-held housing;

b. Said housing formed by first and second elongated members which engage along a length of said housing to provide a unitary housing;

c. A shaver head positioned at one end of said housing;

d. Said shaver head having a short hair cutter including an inner assembly of cutter blades, and, a hair trimmer having a reciprocating cutter including a plurality of cutter teeth;

e. An electric motor positioned within said housing;

f. Coupling means for mechanically coupling said motor to said cutter blade assembly and to said trimmer cutter for simultaneously imparting reciprocating motion thereto;

g. Said coupling means including first and second drive bodies having independently movable segments integrally formed therein for engaging said cutter blade assembly and said trimmer cutter;

h. Each of said drive bodies having a generally U-shaped configuration including a platform segment, first and second leg segments depending from said platform segments, first and second relatively thin walled segments, and first and second support members integrally formed with said first and second relatively thin walled segments, respectively for engaging said housing members and supporting said drive bodies within said housing.

2. The improved electric dry shaver of claim 1 wherein said first and second housing segments each include integrally formed ribs and support members for said first and second drive bodies include grooves formed therein for engaging said housing ribs.

3. The improved shaver arrangement of claim 2 wherein said support members have lower surfaces thereof and include grooves formed in said lower surfaces for engaging said ribs of said housing members.

4. An improved electric dry shaver comprising:

a. An elongated, hand-held housing;

b. Said housing formed by first and second elongated members which engage along a length of said housing to provide a unitary housing;

c. A shaver head positioned at one end of said housing;

d. Said shaver head having a short hair cutter including an inner assembly of cutter blades, and, a hair trimmer having a reciprocating cutter including a plurality of cutter teeth;

e. An electric motor positioned within said housing;

f. Coupling means for mechanically coupling said motor to said cutter blade assembly and to said trimmer cutter for simultaneously imparting reciprocating motion thereto;

g. Said coupling means including first and second drive bodies having first and second drive engaging segments, respectively which are independently movable;

h. Each of said first and second drive bodies having a generally U-shaped configuration and including platform segments and leg segments depending from said platform segments;

i. Each of said drive bodies including first and second relatively thin wall segments extending from a distal part of said leg segments;

j. Each of said relatively thin wall segments forming a generally U-shaped configuration with said leg segment at said distal part;

k. First and second support members integrally formed with said first and second relatively thin walled sements respectively for supporting said drive body within said housing;

l. Said support members of said first drive body including means for engaging said first housing segment and supporting said first drive body therefrom; and, m. Said support members of said second drive body including means for engaging said second housing segment and supporting said second drive body therefrom.

5. An improved electic dry shaver comprising:

a. An elongated, hand-held housing;

b. Said housing formed by first and second elongated members which engage along a length of said housing to provide a unitary housing;

c. A shaver head positioned at one end of said housing;

d. Said shaver head having a short hair cutter including an inner assembly of cutter blades, and, a hair trimmer having a reciprocating cutter including a plurality of cutter teeth;

e. An electric motor positioned within said housing;

f. Coupling means for mechanically coupling said motor to said cutter blade assembly and to said trimmer cutter for simultaneously imparting reciprocating motion thereto;

g. Said coupling means including first and second drive bodies having segments integrally formed therein for engaging said cutter blade assembly and said trimmer cutter;

h. Each of said drive bodies having a generally U-shaped configuration including a platform sement, first and second leg segments depending from said platform segments, first and second relatively thin walled segments, and first and second support members integrally formed with said first and second relatively thin walled segments, respectively for engaging said housing members and supporting said drive bodies within said housing, and;

i. Means for interlocking said first and second support members, respectively of said first and second drive bodies.

6. The improved electric dry shaver of claim 5 wherein said interlocking means includes a groove formed in said support member of said first support body and tab means integrally formed and extending from said first support member of said second support body and shaped for engaging said groove to thereby interlock said first and second support bodies.

* * * * *